US010026580B2

(12) United States Patent
von zur Muehlen

(10) Patent No.: US 10,026,580 B2
(45) Date of Patent: Jul. 17, 2018

(54) COMPACT MODULAR FUSE BLOCK WITH INTEGRATED FUSE CLEARANCE

(75) Inventor: Patrick A. von zur Muehlen, Wildwood, MO (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 236 days.

(21) Appl. No.: 13/184,962

(22) Filed: Jul. 18, 2011

(65) Prior Publication Data

US 2012/0019345 A1 Jan. 26, 2012

(51) Int. Cl.

| | |
|---|---|
| ***H01H 85/50*** | (2006.01) |
| ***H01H 85/20*** | (2006.01) |
| *H01H 9/02* | (2006.01) |
| *H01H 11/00* | (2006.01) |
| *H01H 85/25* | (2006.01) |

(52) U.S. Cl.

CPC ..... *H01H 85/204* (2013.01); *H01H 85/50* (2013.01); *H01H 9/0264* (2013.01); *H01H 11/0031* (2013.01); *H01H 85/25* (2013.01); *H01H 2085/207* (2013.01); *H01H 2085/209* (2013.01); *H01H 2085/2065* (2013.01); *Y10T 29/49117* (2015.01)

(58) Field of Classification Search

CPC .... H01H 85/50; H01H 85/204; H01H 9/0264; H01H 11/0031; H01H 85/25; H01H 2085/2065; H01H 2085/207; H01H 2085/209; Y10T 29/49117

USPC ..... 337/194, 198, 211, 214

See application file for complete search history.

(56) References Cited

U.S. PATENT DOCUMENTS

| | | | | | |
|---|---|---|---|---|---|
| 348,048 | A | * | 8/1886 | Perkins | 337/194 |
| 2,091,204 | A | * | 8/1937 | Horn | 337/188 |
| 2,186,813 | A | * | 1/1940 | Adam et al. | 337/210 |
| 2,220,698 | A | * | 11/1940 | Adam et al. | 439/698 |
| 2,907,849 | A | * | 10/1959 | Kobryner | 337/196 |
| 3,265,830 | A | * | 8/1966 | Kobryner | 337/195 |
| 3,418,615 | A | * | 12/1968 | Canney | 337/190 |
| 3,436,711 | A | * | 4/1969 | Borzoni | 337/198 |
| 3,993,395 | A | | 11/1976 | Taylor | |
| 4,500,162 | A | * | 2/1985 | Keglewitsch et al. | 439/830 |
| 4,536,046 | A | | 8/1985 | Erickson | |
| 5,076,118 | A | * | 12/1991 | Lawson | 81/3.8 |
| 5,820,413 | A | * | 10/1998 | Yamada et al. | 439/620.26 |
| 6,157,287 | A | * | 12/2000 | Douglass | H01H 85/203 337/159 |
| 6,407,656 | B1 | * | 6/2002 | Konda et al. | 337/194 |

(Continued)

FOREIGN PATENT DOCUMENTS

| | | |
|---|---|---|
| DE | 730252 C | 1/1943 |
| DE | 922360 C | 1/1955 |

(Continued)

OTHER PUBLICATIONS

FR/1,443,344 (Jun. 24, 1966), English Translation.*

(Continued)

*Primary Examiner* — Anatoly Vortman
(74) *Attorney, Agent, or Firm* — Armstrong Teasdale LLP

(57) ABSTRACT

A fuse block assembly includes a nonconductive base formed with pedestal surfaces attachable to terminals from a location above the base, while providing a clearance between the body of a fuse and the middle portion of the base when a fuse is installed.

16 Claims, 3 Drawing Sheets

(56) References Cited

U.S. PATENT DOCUMENTS

| | | | | |
|---|---|---|---|---|
| 6,753,754 | B1 | 6/2004 | Black et al. | |
| 7,948,353 | B2 * | 5/2011 | Deno et al. | 337/205 |
| 8,242,874 | B2 * | 8/2012 | Pavlovic et al. | 337/187 |
| 8,419,475 | B2 * | 4/2013 | von zur Muehlen | 439/620.26 |
| 2009/0243786 | A1 | 10/2009 | Buettner | |

FOREIGN PATENT DOCUMENTS

| | | | |
|---|---|---|---|
| DE | 1804381 | U | 1/1960 |
| DE | 7038594 | U | 1/1971 |
| DE | 2506365 | A1 | 8/1976 |
| DE | 9006878 | U1 | 8/1990 |
| DE | 29906759 | U1 | 7/1999 |
| DE | 19836154 | A1 | 4/2000 |
| FR | 1443344 | A | 6/1966 |

OTHER PUBLICATIONS

DE/730, 252 (Jan. 8, 1943), English Translation.*
International Search Report and Written Opinion of PCT/US2011/044714; dated Oct. 20, 2011; 14 pages.
International Search Report and Written Opinion of International Application No. PCT/US2011/044714; dated Oct. 20, 2011; 14 pages.
International Search Report and Written Opinion of PCT/US2011/044608; dated Mar. 22, 2012; 21 pages.

* cited by examiner

COMPACT MODULAR FUSE BLOCK WITH INTEGRATED FUSE CLEARANCE

CROSS REFERENCE TO RELATED APPLICATIONS

This application claims the benefit of U.S. Provisional Patent Application Ser. No. 61/366,217 filed Jul. 21, 2010, the disclosure of which is hereby incorporated by reference in its entirety.

BACKGROUND OF THE INVENTION

The field of the invention relates generally to fuseholders or fuse blocks, and more specifically to modular fuse blocks adaptable for use with overcurrent protection fuses having opposed, axially extending terminal blade contacts.

Electrical fuses are overcurrent protection devices for electrical circuitry, and are widely used to protect electrical power systems and prevent damage to circuitry and associated components when specified circuit conditions occur. A fusible element or assembly is coupled between terminal elements of the electrical fuse, and when specified current conditions occur, the fusible element or assembly melts or otherwise structurally fails and opens a current path between the fuse terminals. Line side circuitry may therefore be electrically isolated from load side circuitry through the fuse, preventing possible damage to load side circuitry from overcurrent conditions.

A considerable variety of overcurrent protection fuses are known and have been used to some extent with a corresponding variety of fuseholders or fuse blocks. Conventional fuse holders are constructed with a certain type of fuse in mind (e.g., cylindrical fuses versus rectangular bodied fuses), having certain ratings (e.g. voltage and current ratings) and certain types of terminations (e.g., ferrules versus blade contacts). For higher powered electrical systems, square or cylindrical bodied fuses are known having blade-type terminal elements extending axially from opposed ends of the fuse bodies to meet the increased demands of higher power applications. Improvements in fuse blocks for such fuses are desired.

BRIEF DESCRIPTION OF THE DRAWINGS

Non-limiting and non-exhaustive embodiments are described with reference to the following Figures, wherein like reference numerals refer to like parts throughout the various drawings unless otherwise specified.

DETAILED DESCRIPTION OF THE INVENTION

Figure 1:
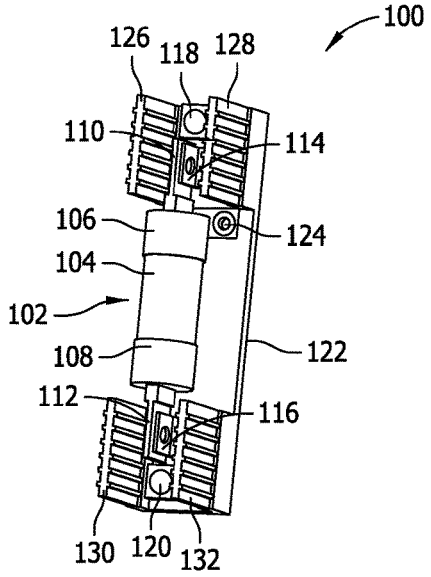
FIG. 1 is a perspective view of a first exemplary modular fuse block assembly.

Fuse blocks adapted for high power, high current circuitry present certain manufacturing issues. In order to understand the inventive concepts disclosed herein to their fullest extent, some discussion of the state of the art is warranted.

In general, any fuse block typically includes a nonconductive base provided with conductive fuse terminals and conductive connection terminals. The connection terminals facilitate electrical connections to line and load side circuitry, and the fuse terminals facilitate electrical connections through the fuse element internal to the body of the fuse. The fuse terminals of the fuse block are typically established with fuse clips constructed to resiliently receive terminal elements of the electrical fuse, such as ferrules or blade-type contacts that extend from opposing axial ends of the fuse body. The terminal elements of an electrical fuse can be inserted into and removed from the fuse clips of a fuse block while the line side and load side connections remain in place. Because of their convenience, fuse blocks are in common use, and when used in groups they facilitate a number of fused electrical connections in a side-by-side arrangement for optimal use of space in an electrical power system.

Except for fuses having relatively low current and voltage ratings, as the voltage and current ratings of any given type of fuse increase, the size of the electrical fuse also tend to increase, including but not limited to the size of the terminal elements extending from the axial ends of the fuse. As such, smaller capacity fuses will typically require a smaller fuse block because both the body of the fuse and the terminal elements tend to be smaller than larger capacity fuses. Fuse blocks for fuses having lower voltage and current ratings are therefore typically smaller than fuse blocks for higher rated fuses. Especially for increasingly higher rated fuses, dimensional differences in the bodies of the fuses and the terminal elements can be substantial.

Accordingly, simply from a materials perspective, lower rated fuse blocks for use with lower rated fuses are typically cheaper to manufacture than larger rated fuse bocks for higher rated fuses. Like the fuses themselves, however, the fuse blocks are not simply scalable to provide larger ratings. This is especially so for high voltage fuses having current ratings of about 100 A or above, where considerable variations in physical package size exists.

For higher powered electrical systems, square or cylindrical bodied fuses are known having more substantial terminal elements extending axially from opposed ends of the fuse bodies, and also more substantial fuse elements for the increased demands of higher power applications. For example, cylindrical Class J fuses, Class R fuses, and Class H(K) fuses are available having voltage ratings of, for example 250V AC or 600V AC and current ratings of 100 A, 200 A, 400 A or 600 A. Such cylindrical fuses may include ferrules or knife blade contacts extending axially from opposing ends of the cylindrical, insulative fuse body, with a fuse element or fusible assembly extending between the ferrules or knife blades interior to the fuse body.

Because such higher rated fuses themselves can be rather substantial in size, so can the fuse blocks that accommodate them. That is, the fuses and fuse blocks tend to be relatively large in order to meet the relatively high power and high current requirements of the power system with which they are used. The terminal elements of the fuses are also larger in higher rated fuses and hence require larger fuse terminals on the fuse blocks. Increased force is required to engage and disengage comparatively larger terminal elements of the fuses with corresponding larger fuse terminals of the fuse block, and tools such as fuse puller tools are often utilized to remove a fuse from the fuse block.

Conventional fuse blocks include generally flat and planar base constructions with the fuse clips mounted in a spaced apart relation thereon. The fuse clips and connecting terminals, which are often integrally formed or pre-assembled prior to assembly of the fuse block, are often mounted on the ends of the flat base so as to accommodate an electrical fuse therebetween. Through holes are typically provided in the base and the clips and connecting terminals are typically attached to the base from the bottom side of the base using mounting fasteners such as screws, and insulation features are typically provided to ensure that the screws are electrically isolated on the underside of the base so as to preclude electrical short circuits when the fuse block is mounted for use.

Assembling the fuse clips and connecting terminals to the base from the bottom or underside of the base can present practical challenges. In particular, it can be difficult to align the fuse clips and terminals with one another and also with the through holes in the base so that the mounting screws can be fastened. Electrically isolating the mounting screws, without damaging the insulation features to electrically isolate them, presents further challenges.

Still further, the fuse clips provided on the fuse block are relatively large for higher rated fuses. In order to accept the knife blade contacts of higher rated fuses and still provide a clearance so that fuse pullers and the like can be used to remove the fuse, the fuse clips are typically taller (measured in a direction perpendicular to the plane of the generally flat base) than the corresponding dimension of the fuse body for which the base has been designed. Considering the relatively large dimensions of the knife blade contacts provided on higher voltage and current rated fuses, the resultant fuse clips must be comparatively larger. Consequently, the fuse clips can themselves be rather large and expensive components to manufacture from both material and process perspectives. Also because the fuse clips are fabricated from conductive materials (e.g., copper, aluminum or other alloy), they are relatively heavy components. This, in turn, requires additional structural strength in the base of the fuse block, requiring additional material in the base construction that further increases the cost of manufacture of the fuse block.

It would be desirable to provide lighter, less expensive, and easier to manufacture fuse blocks for higher rated square or cylindrical bodied fuses having blade contacts extending axially from opposed ends of the fuse bodies, to meet the increased demands of higher power applications.

Exemplary embodiments of fuse holders that may be used in combination to define fuse blocks are described below that address and overcome at least the problems discussed above. Method aspects of the inventive concepts will be in part apparent and in part explicitly discussed in the following description.

FIG. 1 illustrates an exemplary fuseholder 100 for use with cylindrical bodied fuses having opposed, axially extending terminals including blade contacts. The fuseholder 100 is accordingly configured to accommodate a fuse 102 having a generally cylindrical body 104 and conductive terminal elements 106 and 108. In various embodiments, the fuse 102 may be a Class J fuse, Class R fuse, or Class H(K) fuse rated at 600V AC (or less) and having current ratings of 100 A to 600 A. A fuse element completes a conductive path interior to the body 100 between the conductive terminal elements 106 and 108, which may include knife blade terminal contacts 110. 112 as shown extending in opposed, axially extending directions on either end of the fuse body 104.

While a generally cylindrical fuse body 104 is shown having a rounded cross section, the fuse body may alternatively be shaped as a polygonal body having a square or rectangular cross section in other embodiments, such as in NH fuses that those in the art would no doubt recognize.

The knife blade contacts 110, 112 are received by fuse terminals 114 and 116 that define fuse clips to receive the knife blade contacts 110, 112. Connection terminals 118, 120 are also provided proximate the fuse terminals 114, 116 and define termination structure to establish line side and load side electrical connections to electrical circuitry of an electrical power system. The line side and load side connections to the fuse holder 100 are typically established with wires using any one of a variety of techniques known in the art, such as, for example, terminal screws and/or box lug terminals accepting stripped wire ends, ring terminals, etc. While the fuse terminals 114, 116 and the connection terminals 118, 120 are indicated as separate features, it is recognized that the fuse terminals and connection terminals need not be separately provided in all embodiments. In some embodiments, the fuse terminals and the connection terminals can be integrally formed, while in other embodiments they may be assembled to one another, either before or during their assembly with the fuse holder base 122.

The fuse terminals 114, 116 and the connection terminals 118, 120 of the fuseholder 100 are further provided on a nonconductive base piece 122 that may be configured for mounting to an electrical panel, chassis, or other support structure via a mounting bore 124 and a fastener (not shown). Nonconductive barrier elements 126, 128, 130 and 132 may be provided to form partial compartments for the fuse terminals 114, 116 and the connecting terminals 118, 120. In the example shown, the barrier elements 126, 128, 130 and 132 extend generally perpendicular to the base piece 122 and extend only adjacent the terminals 114, 116, 118, 120 while leaving the fuse body 104 generally exposed. As such, a technician can grasp the body 104 of the fuse 102 by hand, or if needed with a fuse puller tool, and extract it from the line and load side fuse terminals 114, 116 without being hindered by the barrier elements 126, 128, 130 and 132.

A number of fuseholders 100 may be individually mounted side-by-side to form a multi-pole fuse block, with the barrier elements 126, 128, 130 and 132 separating adjacent line and load side terminals 114, 116, 118, 120 in the adjacent fuse holders in the block. Some degree of protection is therefore provided against inadvertently shorting the line or load side terminals as the fuse blocks are serviced. The barrier elements 126, 128, 130 and 132 also offer some protection against a risk of electrical shock via inadvertent contact by a technician's fingers, and some degree of "finger safe" operation is therefore provided. However, while the barrier elements 126, 128, 130 and 132 provide some assurance against inadvertent contact with the line and load side terminals. If desired, cover elements for the terminals 114, 116, 118, 120 may be optionally provided. Exemplary covers are disclosed in the related application referenced above, although others are possible.

Unlike conventional fuse holders, the base 122 is not a generally flat and planar element, but rather is fabricated with varying thickness to provide a clearance between the fuse body 104 and the upper surface of the base 122, while simultaneously allowing smaller fuse clips 114 and 116 to be used. This is accomplished by fabricating the base 122 to include pedestals or platforms on the opposing ends thereof such that the fuse clips 114 and 116 when respectively mounted thereon are raised from the remainder of the base 122 extending between the ends of the base 122. As such, the ends of the base 122 are not flush with the middle of the base 122, and a recessed area is created between the platforms on the ends of the base 122. The recessed area can accommodate a portion of the fuse body 104, while still allowing a fuse puller tool to be used to remove the fuse 102. A portion of the fuse body 104 may extend below the fuse clips 114 and 116 into the recessed area on the base 122, while the knife blade contacts 110, 112 of the fuse are fully engaged with the fuse terminals 114 and 116. Beneficially, this allows smaller fuse terminals 114 and 116 to be used than would otherwise be necessary if the platforms were not present. The reduction in size of the fuse terminals 114 and 116 allows corresponding materials savings, and also process improvements for manufacturing the fuse terminals 114 and 116.

The clearance features alluded to above are similarly provided in the fuse holder 200 shown in FIGS. 2 and 3 having a slightly different arrangement of terminals and barrier elements described below. It should be understood, however, that the clearance features described are not necessarily limited to any particular arrangement or configuration of terminals or barrier elements. The exemplary embodiments shown in the Figures are provided for the sake of illustration rather than limitation.

Turning now to FIGS. 2-5, the fuse holder 200 includes a nonconductive base 202 and a plurality of terminal segments 248 in the form of fuse terminals 204, 206 and connection terminals 208, 210 (shown as lug terminals). In the example shown, the fuse terminals 204, 206 are configured as fuse clips to engage the knife blade contacts 110, 112 (FIG. 3) of the fuse 102. While a single pair of fuse terminals 204, 206 and a single pair of connection terminals 208, 210 are shown, additional pairs of fuse terminals 204, 206 and connection terminals 208, 210 may be provided to define a multiple pole fuse block on a single base 202 that is capable of accommodating more than one fuse.

Figure 5:
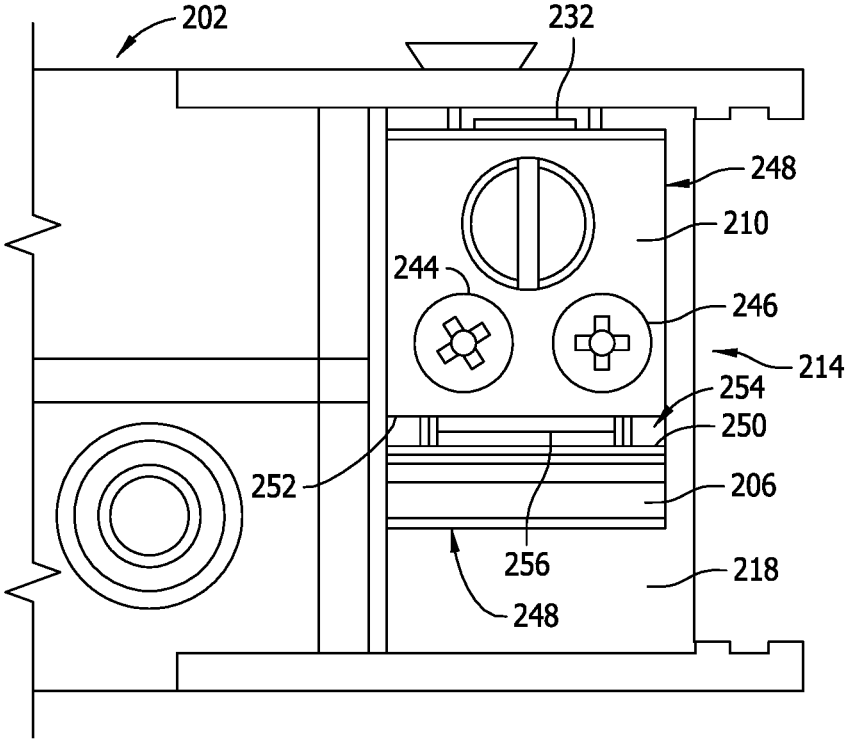
FIG. 5 is an enlarged region of the fuse block assembly shown in FIG. 4.

In the example shown, the fuse terminal 204 is integrally provided with the connection terminal 208 and the fuse terminal 206 is integrally provided with the connection terminal 210. With reference to FIG. 5, each fuse terminal 204, 206 has a contact surface 250, and each connection terminal 208, 210 has a contact surface 252, such that a fuse blade slot 254 is defined between each pair of opposing contact surfaces 250, 252. In this manner, from the top-down viewpoint as shown in FIG. 5, opposing contact surfaces 250, 252 overlap one another along a vertical plane 256 which extends through the corresponding fuse blade slot 254 and is oriented parallel to the contact surfaces 250, 252. The terminals 204, 208 therefore define a line side connection to external circuitry through the fuse 102, and the terminals 206, 210 provide a load side connection to the external circuitry. When the fuse 102 is seated on the fuse holder 200 with the knife blade contacts 110, 112 inserted into the fuse blade slots 254 (as shown in FIG. 3), a fuse element internal to the fuse body 104 and connected between the knife blade contacts 110, 112 is constructed to provide overcurrent protection in a known manner to electrically isolate the load side circuitry from line side circuitry when needed.

The base 202 in the exemplary embodiment shown is an elongated body including a first axial end portion or section 212, a second axial end portion or section 214 opposing the first end section 212, and an elongated main section 215 extending between the axial end section 212, 214. Each end section 212, 214 includes a raised pedestal or platform surface 216, 218 upon which the terminals 204, 208 and 206, 210 are mounted. The main section 215, extending between the pedestal or platform surfaces 216, 218 defines a recessed or depressed surface 220 relative to the raised platform surfaces 216, 218. That is, rather than the end sections 212, 214 being the same thickness, sometimes being referred to as being flush with the main portion 215, the surface 220 of the main section 215 extends at a lower elevation than the surfaces 216, 218 of the end sections 212, 214. The pedestal surfaces 216, 218 are generally coplanar to one another in the embodiment shown, with the surface 220 of the main section 215 extending at a predetermined offset distance from the pedestal surfaces 216, 218. From the perspective of FIG. 2, the end sections 212, 214 are thicker than the middle portion 215, imparting a channel-like shape to the overall base 202.

Figure 3:
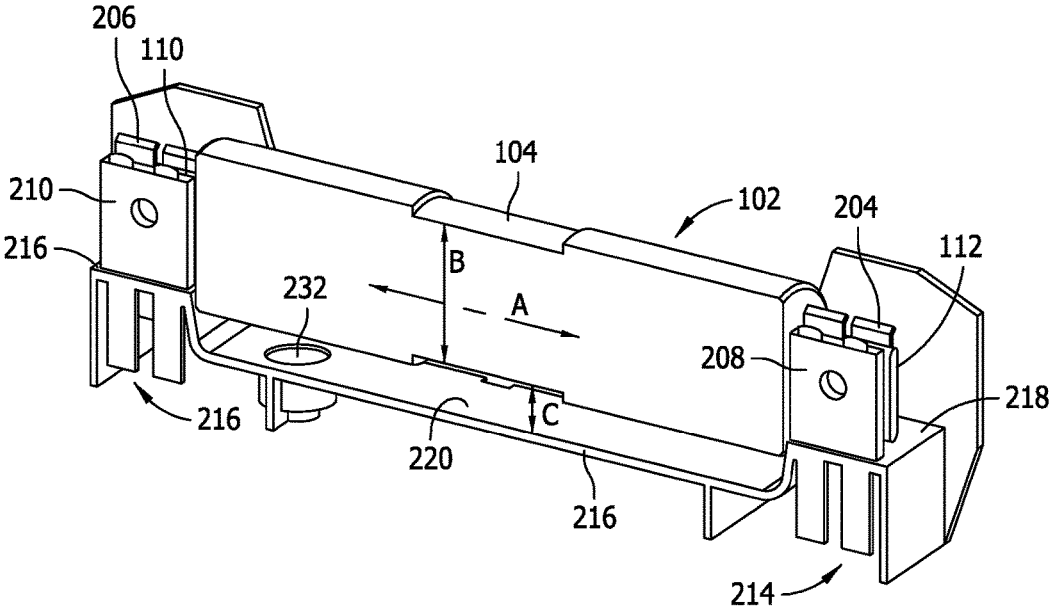
FIG. 3 is a sectional view of the fuse block assembly shown in FIG. 2 with a fuse installed.

As seen in the sectional view of FIG. 3, the surfaces 216, 218, 220 collectively provide a clearance C between the lower surface of the fuse body 104 and the depressed surface 220 of the base 202, while the knife blade contacts 110, 112 of the fuse 102 are otherwise fully engaged and received in the respective fuse terminals 204, 206. The fuse terminals 204, 206 are generally sized only to correspond to the lateral dimension of the knife blade contacts 110, 112 (measured perpendicularly to the longitudinal axis A of the fuse 102 as shown in FIG. 3), and not to accommodate the larger lateral dimension, shown as dimension B in FIG. 3, of the fuse body 104.

As such, the fuse terminals 204, 206 have a height dimension, measured in a direction parallel to the dimension B of the fuse body 104 in FIG. 3, that is less than the corresponding height dimension B of the fuse body 104. In the case of the cylindrical fuse 102 as shown, the height dimension B corresponds to the outer diameter of the fuse body 104. Because of the height differences between the fuse terminals 204, 206 and the fuse body 104, when the fuse 102 is installed as shown in FIG. 3, a portion of the fuse body 104 extends below the raised platform surfaces 216, 218 and also below the fuse terminals 204, 206 respectively mounted thereupon. Alternatively stated, in the example shown the portion of the fuse body 104 nearest to the main base surface 220 when the fuse 102 is engaged to the fuse clips 204, 206 resides at an elevation in between and different from either of the elevations of the surfaces 216, 218, 220 of the fuse block base 202.

The clearance C provided when the fuse 102 is installed in the exemplary embodiment is actually a bit less than the elevational distance or difference between the raised platform surfaces 216, 218 and the depressed surface 220 of the main section 215 of the base 202. The actual dimension of the clearance C may be varied in different embodiments by varying the predetermined distance between the surfaces 216, 218 and the surface 220, although as a general proposition the distance should be selected to provide at least the minimal clearance necessary to allow a fuse puller tool to be used to extract the fuse 102 from the fuse holder 200.

The surfaces 216, 218, 220 of the base 202 therefore facilitate a reduction in the size of the clips 204, 206 needed to complete the electrical connections to the fuse 102. A smaller amount of comparatively expensive and more difficult to process conductive material can be utilized to manufacture the fuse clips 204, 206. The platform surfaces 216, 218 raise the elevation of the fuse clips 204, 206 so that a reduced size of the fuse clips is possible, while the depressed surface 220 of the main base section 215 facilitates the necessary clearance C to accommodate the relatively larger fuse body 104 and any fuse puller tool that may be necessary to extract the fuse. The platform surfaces 216, 218 are provided using a comparatively less expensive, and easier to process material than the conductive material used to fabricated the fuse terminals 204, 206.

In one embodiment, the base 202 including the raised surfaces 216, 218 and the depressed surface 220 may be fabricated from a nonconductive material, such as heavy duty plastic, and may be fabricated using known molding processes. While illustrated as integral piece in FIGS. 2 and 3, the base 202 may be fabricated from more than one section that is assembled to one another. For example, the end sections 212, 214 including the platform surfaces 216, 218 may be separately provided from the main base section 215. Likewise, the base section 215 may be fabricated from more than one section if desired.

Figure 2:
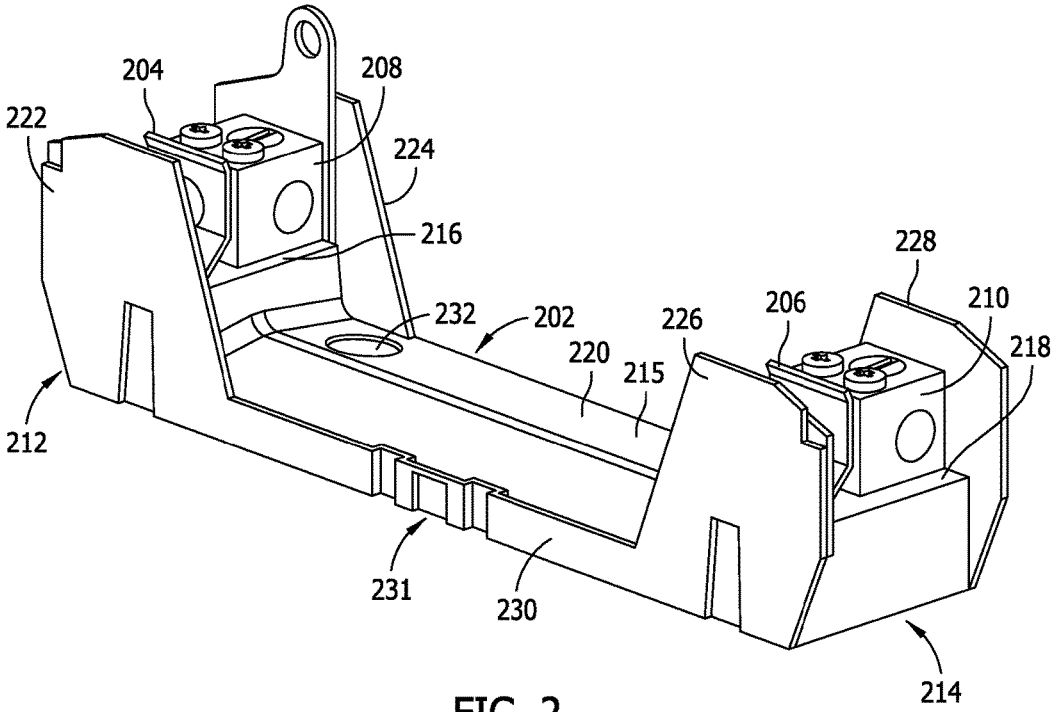
FIG. 2 is a perspective view of a second embodiment of a modular fuse block assembly.

As shown in FIGS. 2 and 3, the base 202 may further be provided with barrier walls 222, 224, 226, 228 each projecting upwardly from the depressed surface 220 of the main base section 215 proximate the end sections 212, 214 of the base. The terminals 204 and 208 that are seated upon the pedestal surface 216 are flanked by the barrier walls 222 and 224, while the terminals 206 and 210 that are seated upon the pedestal surface 218 are flanked by the barrier walls 226 and 228. The barrier walls 222, 224, 226, 228 therefore provide some degree of protection from inadvertent contact with the energized terminals 204, 206, 208 and 210 in use.

Also shown in FIG. 2, the main base section 215 includes a lateral side edge 230 including a slotted surface 231 that may be used to connect or gang two adjacent fuse holders 200 to one another. As such, two main base sections 215 may be coupled directly to one another or indirectly by using a spacer element such as that described in the related application referenced above. Either way, a multi-pole fuse block may be realized by coupling fuse holders 200 to one another. A mounting aperture 232 is formed in the main base section 215 so that the fuseholder 200 can be mounted to any supporting structure desired using a fastener such as a screw. As seen in the sectional view of FIG. 3, the base 202 is fabricated to have a relatively lightweight, thin-walled construction for even further savings from a manufacturing perspective.

Figure 4:
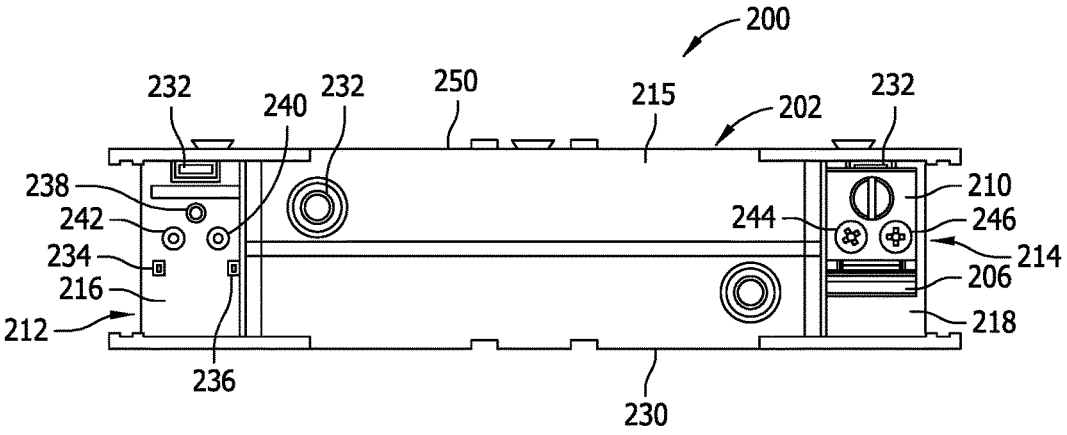
FIG. 4 is a top view of the fuse block assembly shown in FIG. 2 with parts removed.

FIG. 4 illustrates still other beneficial features of the fuse holder 200 providing for assembly advantages over conventional fuse blocks. Each of the end sections 212, 214 include locating features on the platform surfaces 216, 218 that facilitate alignment of the fuse terminal and connection terminal 204, 208 (FIG. 2) on the platform surface 216, and the fuse terminal 206 and connection terminal 210 on the platform surface 218 with relative ease. Specifically, each platform surface 216, 218 includes an alignment tab 232 that cooperates with one of the connection terminals 208, 210. Locator pins 234, 236, and 238 are also provided on each platform surface 216, 218. Each of the locator pins 234, 236, 238 engages a corresponding surface on one of the terminals 204, 206, 208, 210. Multiple reference guide surfaces by virtue of the tabs 236 and the pins 234, 236, 238 practically ensure that the terminals 204, 206, 208, 210 may be quickly located in the proper position and orientation on the platform surfaces 216, 218. Any attempt to locate the terminals 204, 206, 208, 210 in an improper position or orientation is effectively frustrated.

Further, blind holes 240, 242 are provided in each platform surface 216, 218 so that, once the terminals 204, 206, 208, 210 are properly located, the terminals may be attached with fasteners such as screws 244, 246 from a location above the pedestal surfaces 216, 218. As shown, the heads of the fasteners 244, 246 are exposed on the top surface of the connection terminal 210 for ease of installation. Because of the various reference guide surfaces described above in the platform surfaces 216, 218 the fastener holes in the terminals may be pre-aligned with the through holes 240, 242 in the pedestal surfaces 216, 218. As such, the terminals 204, 206, 208, 210 may be attached directly from the top side of the base 202 with the terminals in proper alignment and orientation, as opposed to conventional fuse blocks wherein the terminals are attached from underneath the base and alignment difficulties are presented. Assembly of the fuse holder 200 is thus a good deal simpler compared to conventional fuse blocks.

Also, the blind holes 240, 242 that are formed in the plastic base sections 212, 214 inherently electrically isolate the fasteners 244, 246 and eliminates any need for separately provided isolation features common to conventional fuse blocks.

Finally, as seen in FIG. 4, the lateral side 230 of the main base section 215 may be provided with grooves, while the opposing lateral side 250 of the main base section 215 may be provided with tongues. By coupling the tongues and grooves of adjacent fuse holders 200, either directly or indirectly, a fuse block having any number of fuses may be effectively and quickly formed. Likewise, the modular holders 200 may be quickly added or removed from a fuse block to change the number of poles.

The advantages and benefits of the invention are now believed to have been amply illustrated in connection with the exemplary embodiments disclosed.

An embodiment of fuse block for at least one overcurrent protection fuse has been disclosed. The fuse block includes: a nonconductive base including opposing end portions and a middle portion extending axially between the opposing ends, the end portions being elevated relative the middle portion by a predetermined distance; and first and second fuse terminals coupled to the respective elevated end portions.

Optionally, the overcurrent protection fuse includes a body and axially extending blade contacts extending from opposed ends of the body, and the first and second fuse terminals may include first and second fuse clips, with each of the first and second fuse clip configured to accept one of the axially extending blade contacts of the overcurrent protection fuse. Each of the first and second fuse clips may have a first height and the overcurrent protection fuse may include a nonconductive body having a second height, with the second height being greater than the first height. The distance may be selected to provide a clearance between the nonconductive body and the middle portion when the blade contacts are received in the fuse clips.

Each of the opposing end portions may define a pedestal surface including at least one location feature for the respective one of the fuse clips. The first and second fuse clips may be attachable to the respective opposing end portions with fasteners, the fasteners extending through the fuse clips from above the end portions. The fasteners may include at least one screw having a head, the head being accessible from atop the respective fuse clip. The base may further include a lateral side wall, the lateral side wall configured for one of tongue and groove engagement with another base. The overcurrent protection fuse may include a cylindrical body.

Another embodiment of a fuse block for at least one an overcurrent protection fuse including a nonconductive body having an axial length and a height dimension measured in a direction perpendicular to the axial length, and blade contacts projecting axially from opposing ends of the body, has been described. The fuse block includes: a nonconductive base including opposing end portions and a middle portion extending axially between the opposing ends; and first and second fuse clips coupled to the respective end portions of the base, each of the first and second fuse clips being spaced apart and being configured to receive one of the blade contacts of the overcurrent protection fuse, each fuse clip having a height dimension that is less than the height dimension of the fuse; wherein when the blade contacts of the fuse are engaged to the first and second fuse clips, a portion of the body of the fuse extends below the fuse clips but is spaced from the middle portion of the base.

Optionally, the end portions of the base may be elevated from the middle portion. The end portions of the base may be elevated by a distance that provides a clearance between the nonconductive body and the middle portion when the blade contacts are received in the fuse clips.

Each of the opposing end portions of the base may define a pedestal surface including multiple location features for the respective one of the fuse clips. The first and second fuse clips may be attachable to the respective opposing end portions of the base with fasteners, the fasteners extending through the fuse clips from above. The fasteners may include at least one screw having a head, the head being accessible from atop the respective fuse clip. The base may further include a lateral side wall, the lateral side wall configured for one of tongue and groove engagement with another base. The overcurrent protection fuse includes one of a cylindrical body and a rectangular body.

Another embodiment of a fuse block for at least one an overcurrent protection fuse including a nonconductive body having an axial length and a height dimension measured in a direction perpendicular to the axial length, and blade contacts projecting axially from opposing ends of the body, has been disclosed. The fuse block includes: a nonconductive base comprising a body including opposing end portions and a middle portion extending axially between the opposing ends; and first and second fuse clips coupled to the respective end portions of the base, each of the first and second fuse clips being spaced apart and being configured to receive a respective one of the blade contacts of the overcurrent protection fuse with the body of the overcurrent protection fuse extending between the first and second fuse clips, each fuse clip having a height dimension that is less than the height dimension of the fuse body; wherein the base is configured such that when the blade contacts of the fuse are engaged to the first and second fuse clips, a clearance is provided between the body of the overcurrent fuse and the middle portion.

The end portions of the base may be elevated from the middle portion to provide the clearance. Each of the opposing end portions of the base may define a pedestal with an attachment surface, the attachment surface including at least one location feature for the respective one of the fuse clips. The first and second fuse clips may be attachable to the respective opposing end portions of the base with fasteners, the fasteners extending through the fuse clips from above the end portions of the base. The fasteners include at least one screw having a head, the head being accessible from atop the respective fuse clip. The base may further include a lateral side wall, the lateral side wall configured for one of tongue and groove engagement with another base. The overcurrent protection fuse may include one of a cylindrical body and a rectangular body.

An embodiment of a fuse block has also been disclosed including: at least one nonconductive base having a main section and opposed end sections extending axially away from the main section; and first and second conductive terminals each respectively coupled to one of the opposed end sections and configured to establish electrical connection through an overcurrent protection fuse including a fuse body and opposed, axially extending blade contacts extending from the fuse body; wherein the main section and the end sections are formed with different thickness.

Optionally, the first and second fuse terminals may be fuse clips configured to engage the blade contacts. The thickness of the end sections is greater than the thickness of the main section, thereby providing a clearance for the fuse body at a location below the end sections. The end sections may be formed with multiple locator surfaces configured to align the first and second terminal elements. The first and second terminal elements may be coupled to the end sections with fasteners extended into the end sections from a location above the end sections.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A fuse block for at least one fuse having axially extending knife blade contacts respectively extending from opposed ends of a fuse body, the fuse block comprising:

at least one nonconductive base having a pair of elevated end portions respectively defining a pedestal surface and a recessed middle portion extending between the pair of elevated end portions;

an exposed box lug mounted to each pedestal surface;

an exposed resilient fuse clip arm positioned adjacent the box lug on each pedestal surface, the resilient fuse clip arm being separately provided from the box lug and being deflectable relative to the box lug to receive a respective one of the knife blade contacts of the fuse and secure each knife blade contact in surface contact with the box lug with the fuse body being spaced from the recessed middle portion; and a first barrier wall extending alongside the box lug and a second barrier wall extending alongside the resilient fuse clip arm, wherein each of the first barrier wall and the second barrier wall extends above the pedestal surface to provide a degree of protection to a person from inadvertently touching the exposed box lug or the exposed resilient fuse clip arm when servicing the fuse.

2. The fuse block of claim 1, wherein the exposed box lug on each pedestal surface includes an exposed top surface extending above each pedestal surface and between the first and second barrier walls, and the fuse block further comprises an exposed fastener on the exposed top surface of the exposed box lug, the exposed fastener being selectively positionable relative to the exposed box lug to establish an electrical connection to the exposed box lug via a connection wire.

3. The fuse block of claim 1:

wherein each elevated end portion of the nonconductive base defines at least one blind hole extending to the pedestal surface;

wherein the fuse block further comprises at least one threaded fastener attaching each exposed box lug to the respective pedestal surface via the at least one blind hole, and the at least one threaded fastener having a head that is exposed on a top surface of the exposed box lug.

4. The fuse block of claim 3, wherein the at least one blind hole in each elevated end portion of the nonconductive base comprises a first blind hole and a second blind hole; and wherein the at least one threaded fastener includes a first threaded fastener and a second threaded fastener each attaching the respective box lug to the respective pedestal, and each of the first threaded fastener and the second threaded fastener respectively having a head that is exposed on the respective top surfaces of each exposed box lug.

5. The fuse block of claim 3, wherein each pedestal surface includes a plurality of location features projecting therefrom and respectively engaging the exposed box lug only when the box lug is in a predetermined orientation relative to the pedestal surface and in alignment with the at least one blind hole.

6. The fuse block of claim 5, wherein the plurality of location features include at least one alignment tab and at least one alignment pin.

7. The fuse block of claim 6, wherein the plurality of location features include three location pins and a location tab each respectively engaging the box lug at different locations.

8. The fuse block of claim 1, wherein the box lug on each pedestal surface has a height dimension, measured perpendicularly to a longitudinal axis of the fuse, that is less than a corresponding height dimension of the fuse body, thereby providing a predetermined clearance between a lower surface of the fuse body and the recessed middle portion of the nonconductive base when the knife blade contacts are secured to each of the exposed box lugs.

9. The fuse block of claim 8, wherein the predetermined clearance is selected to accommodate a fuse puller tool for extracting the fuse from the fuse block.

10. The fuse block of claim 8, wherein the fuse body is cylindrical.

11. The fuse block of claim 8, wherein the fuse is selected from the group consisting of a Class J fuse, a Class R fuse, or a Class H(K) fuse.

12. The fuse block of claim 11, wherein the fuse has a current rating of 100 A to 600 A.

13. The fuse block of claim 12, wherein the fuse has a voltage rating of 250V AC to 600V AC.

14. The fuse block of claim 1, wherein the middle portion includes at least one mounting aperture to mount the nonconductive base to a support structure.

15. The fuse block of claim 1, wherein the nonconductive base includes lateral side edges each configured to connect or gang a plurality of nonconductive bases to one another and form a multi-pole fuse block.

16. The fuse block of claim 15, wherein the lateral side edges of the nonconductive base are configured for tongue and groove engagement with another one of the nonconductive bases.

* * * * *